United States Patent [19]

Oogita et al.

[11] Patent Number: 4,762,983

[45] Date of Patent: Aug. 9, 1988

[54] THIN ELECTRONIC APPARATUS

[75] Inventors: Yoshinori Oogita; Katsuhide Shino; Kazuhiro Nakao; Kazuhito Ozawa; Shigeki Komaki, all of Nara, Japan

[73] Assignee: Sharp Kabushiki Kaisha, Osaka, Japan

[21] Appl. No.: 783,465

[22] Filed: Oct. 3, 1985

[30] Foreign Application Priority Data

Oct. 5, 1984 [JP] Japan ..... 59-151653[U]

[51] Int. Cl.[4] ..... G06C 5/02

[52] U.S. Cl. ..... 235/1 D; 235/145 R; 428/349; 156/306.6; 200/5 A

[58] Field of Search ..... 235/1 D, 145 R; 156/306.6, 108, 182, 293, 295, 309.9, 322, 324.4; 200/5 A; 428/1, 349

[56] References Cited

U.S. PATENT DOCUMENTS 3,939,024 2/1976 Hoggatt ..... 156/306.6 X
4,056,881 11/1977 Holt et al. ..... 156/306.6 X
4,160,886 7/1979 Wright et al. ..... 235/145 R
4,450,024 5/1984 Haghiri-Tehrani et al. .... 156/306.6 X
4,530,872 7/1985 Pernicano ..... 428/349 X
4,562,315 12/1985 Aufderheide ..... 200/5 A
4,611,261 9/1986 Suwa ..... 200/5 A X

FOREIGN PATENT DOCUMENTS 131543 9/1980 Japan .

*Primary Examiner*—Benjamin R. Fuller
*Attorney, Agent, or Firm*—Birch, Stewart, Kolasch & Birch

[57] ABSTRACT

An electronic apparatus comprising a plurality of assembly elements and a heat-sensitive adhesive synthetic resin film tape inserted between the plurality of assembly elements and the heat adhesive synthetic resin tape to integrally bond the elements together into a composite structure which is thin in size and sufficiently elastic to resist bending and twisting.

3 Claims, 2 Drawing Sheets

THIN ELECTRONIC APPARATUS

BACKGROUND OF THE INVENTION

The present invention relates to an electronic apparatus and, more particularly, to a structure of a thin electronic apparatus such as a thin card-type electronic calculator.

According to the prior art, in order, to make an electronic apparatus as possible, e.g. thin as 1 mm or less, as in the ease of, a card-type electronic calculator, the front panel, the rear panel, the frame, the movement, and the key input unit should be as thin as about 0.1–0.5 mm. Usually, these elements are bonded with a double coated tape. However, the tape of this type is rather thick and does not provide sufficient adhesion strength.

SUMMARY OF THE INVENTION

Accordingly, it is an object of the present invention to provide an improved thin electronic apparatus whose elements are bonded with a heat adhesive synthetic resin film tape using a hot press method.

It is another object of the present invention to provide an improved manufacturing method of manufacturing a card-type electronic apparatus with a hot press method of a heat adhesive synthetic resin film tape.

Briefly described, in accordance with the present invention, an electronic apparatus comprises a plurality of assembly elements, and a heat adhesive synthetic resin film tape inserted between the plurality of assembly elements. A hot press method is applied to the plurality of assembly elements and the heat adhesive film tape to integrally bond the composite together.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
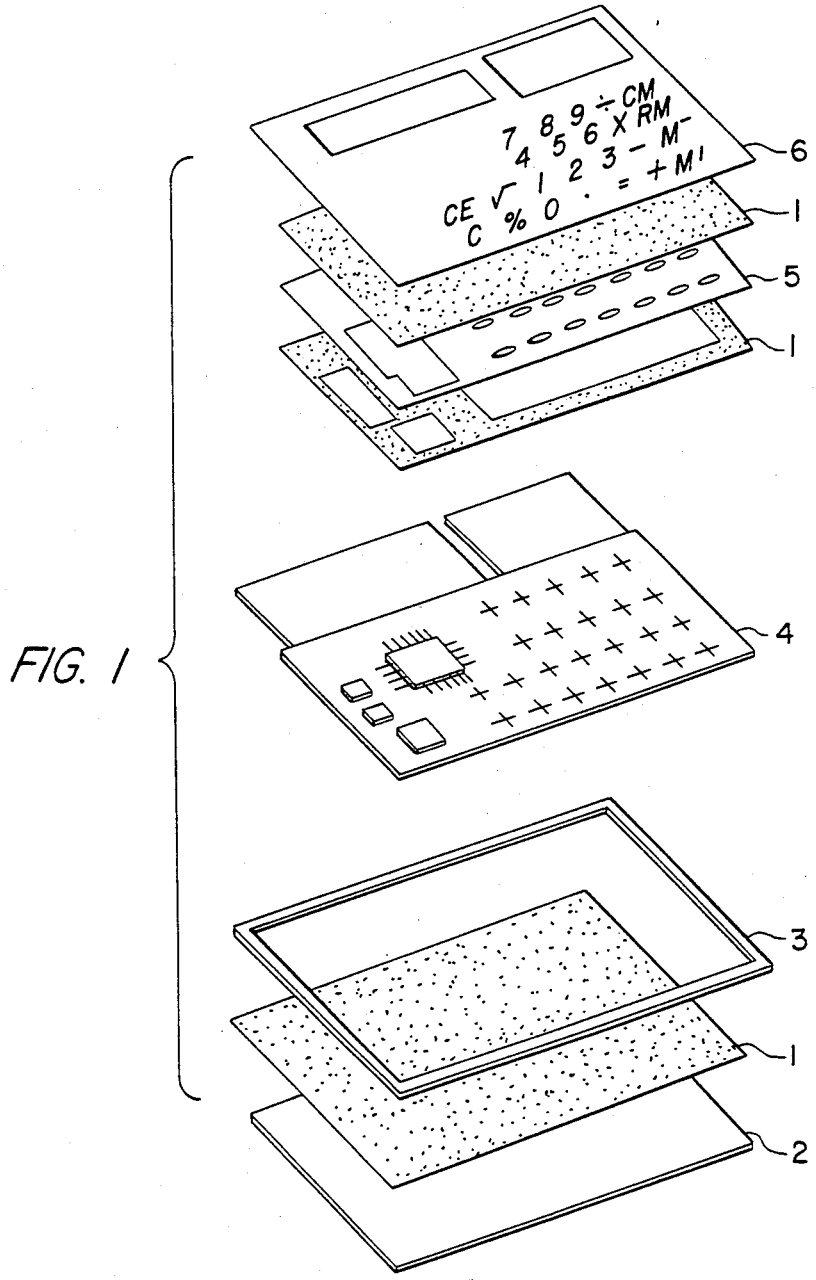
FIG. 1 is an exploded view of a card-type electronic apparatus such as an electronic calculator according to the present invention.

FIG. 1 is an exploded view of a thin electronic apparatus, in particular, a card-type electronic apparatus according to the present invention.

The electronic apparatus of FIG. 1 comprises a base panel 2, a frame 3, a movement 4 comprising a driving circuit and a display device, a key board film 5, and a front panel 6, which are overlaid on one another in this order. Preferably, each of the elements may be about 0.1–0.5 mm in thickness.

According to the present invention, a hot press adhesive tape 1 is provided which is elastic with a film of a synthetic resin of a heat adhesive type. Preferably, the heat adhesive synthetic resin may be a polyamide agent, a copolymerization nylon agent or the like. Such a hot press tape 1 is commercially available under the trade name of SDYNE of Sekisui Kagaku Kogyo KK, Japan (the tape thickness is about 70 μm) or the trade name of Scotchweld of Minnesota Mining and Manufacturing Company, USA (the tape thickness is about 50 μm). The thickness of the hot press adhesive tape 1 is several tens μm.

Figure 2:
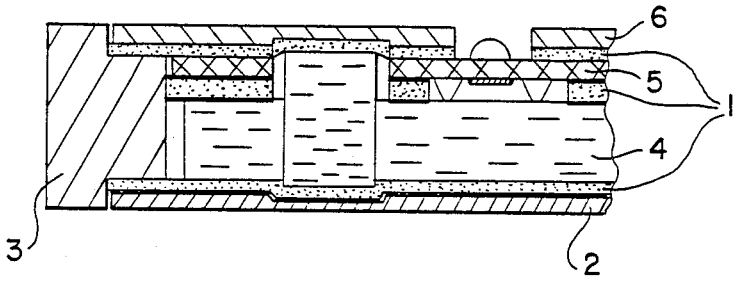
FIG. 2 is a sectional view of the apparatus of FIG. 1.

The hot press adhesive tape 1 is cut into an appropriate size by die cutting or to a similar process. The prepared type 1 is inserted between the elements as shown in FIG. 2. A hot press machine is operated to press the assembly in a hot temperature. Preferably, the pressure for the hot press is about 5 $Kg/cm^2$ and its temperature is about 100–180 degrees Centigrade. With the help of the heat adhesive synthetic resin film of the hot press tape 1 of the present invention, the respective elements of the electronic apparatus can be integrally bonded strongly without peeling off. The shear strength of the hot press adhesive tape 1 is about 100 $Kg/cm^2$ or more. The hot press adhesive film tape 1 is so elastic that the bonded assembly resists bending and twisting.

Since the hot press adhesive tape 1 is used to integrally bond the elements, together there is no fear that the adhesive would invade unnecessary portions of the assembly as would exist if a liquid type adhesive were used.

Because the hot press tape 1 is fairly thin several tens of μm, the bonded electronic apparatus can also be very thin.

While only certain embodiments of the present invention have been described, it will be apparent to those skilled in the art that various changes and modifications may be made therein without departing from the spirit and scope of the present invention as claimed.

What is claimed is:

1. A card-type electronic calculator comprising, as a plurality of assembly elements, a base panel, a driving circuit, a keyboard film and a front panel, including a display device, each having a thickness of about 0.1 to 0.5 μm, and elastic, heat-sensitive adhesive synthetic resinous tape disposed between said base panel and said driving circuit, between said driving circuit and said keyboard film, and between said keyboard film and said front panel, said assembly elements being integrally bound together with the application of heat to form a composite structure which is thin in size and sufficiently elastic to resist bending and twisting, and said assembly elements being contained within a frame.

2. The electronic calculator of claim 1 wherein the shear strength of the heat-sensitive adhesive tape is about 100 $kg/cm^2$.

3. The electronic calculator of claim 1 wherein the heat-sensitive adhesive tape has a thickness of several tens of μm.

* * * * *